United States Patent [19]

Schumacher

[11] 3,942,332

[45] Mar. 9, 1976

[54] COMBINATION LIQUID TRAPPING SUCTION ACCUMULATOR AND EVAPORATOR PRESSURE REGULATOR DEVICE

[75] Inventor: Ernest W. Schumacher, Portsmouth, Va.

[73] Assignee: Virginia Chemicals, Inc., Portsmouth, Va.

[22] Filed: Aug. 6, 1974

[21] Appl. No.: 495,168

Related U.S. Application Data

[62] Division of Ser. No. 388,281, Aug. 14, 1973, Pat. No. 3,858,407.

[52] U.S. Cl. ..... 62/217; 62/503

[51] Int. Cl.[2] ..... F25B 43/00; F25B 41/04

[58] Field of Search ..... 62/217, 503, 474, 196, 62/471, 222

[56] References Cited

UNITED STATES PATENTS 3,798,921 3/1974 Scherer et al. ..... 62/503

3,810,366 5/1974 Orth ..... 62/217

*Primary Examiner*—William E. Wayner

*Attorney, Agent, or Firm*—Depaoli & O'Brien

[57] ABSTRACT

A combination liquid trapping suction accumulator and evaporator pressure regulator device used intermediate the compressor and evaporator in a vapor-compression refrigeration system as a protective device for the compressor. The device is characterized by the positioning of the evaporator pressure regulator chamber intermediate the inlet and outlet ports of the accumulator housing. Thus, evaporator pressure regulation is accomplished simultaneously with liquid accumulation in a compact and readily serviceable, unitary housing.

4 Claims, 2 Drawing Figures

COMBINATION LIQUID TRAPPING SUCTION ACCUMULATOR AND EVAPORATOR PRESSURE REGULATOR DEVICE

This is a division of application Ser. No. 388,281, now U.S. Pat. No. 3,858,407, filed Aug. 14, 1973.

CROSS REFERENCE TO RELATED APPLICATION

A modification of the assignee's earlier filed application entitled LIQUID TRAPPING SUCTION ACCUMULATOR (Ser. No. 359,569), filed May 11, 1973, now abandoned.

The present application is characterized in its combining of an evaporator pressure regulator device with a liquid trapping suction accumulator.

BACKGROUND OF THE INVENTION

Automobile air conditioning and refrigeration systems are conventionally subject to a high rate of failure, due principally to liquid entering the compressor. These failures frequently occur after a short shut-down of the automobile which defeats the thermostatic expansion valve, permitting liquid to migrate from the condenser into the evaporator. As the automobile air conditioning system is restarted, the liquid goes to the compressor with damaging results. The automobile system is characterized by the extraordinarily wide range of flow rates, a principal aim being to return the oil through the eductor, regardless of flow rate.

Liquid suction accumulators are widely employed to solve the problem of liquid entering the compressor. However, there is no prior art showing a combination of these elements within a single working system and utilizing pressure drops obtained, for example, through the evaporator pressure regulator as an assistance in the eduction of oil through the system.

SUMMARY OF THE INVENTION:

According to the present invention, an evaporator pressure regulator (EPR) is interposed between the inlet and outlet ports of an accumulator chamber. The evaporator pressure regulator (EPR) may include an evaporator pressure regulator device of the bellows or other type, regulating vaporous flow from inlet to outlet, according to pressure within the system. The pressure drop obtained through the evaporator pressure regulator device is utilized in drawing oil through the eductor tube.

Modification of the invention includes positioning of an expansion valve within the accumulator housing, use of a combined thermostatic expansion valve and a filter drier adjacent to the accumulator chamber, positioning of both the expansion valve and a desiccant within the accumulator chamber, utilization of a fixed orifice or capillary feeding device intermediate the filter drier and the evaporator in the system, positioning of the evaporator pressure regulator device perpendicularly with respect to the top of the accumulator chamber and providing the evaporator pressure regulator chamber with quick disconnects, fitting and sealing fixtures.

Specifically herein according to the species of FIG. 2 an accumulator chamber includes a removable adapter means having colinear horizontally disposed inlet and outlet ports. Furthermore, the adapter body includes a a threaded portion engaging a correspondingly threaded portion in said outlet port to further define an annulus between the adapter body and the outlet port.

DESCRIPTION OF THE PREFERRED EMBODIMENTS

Figure 1:
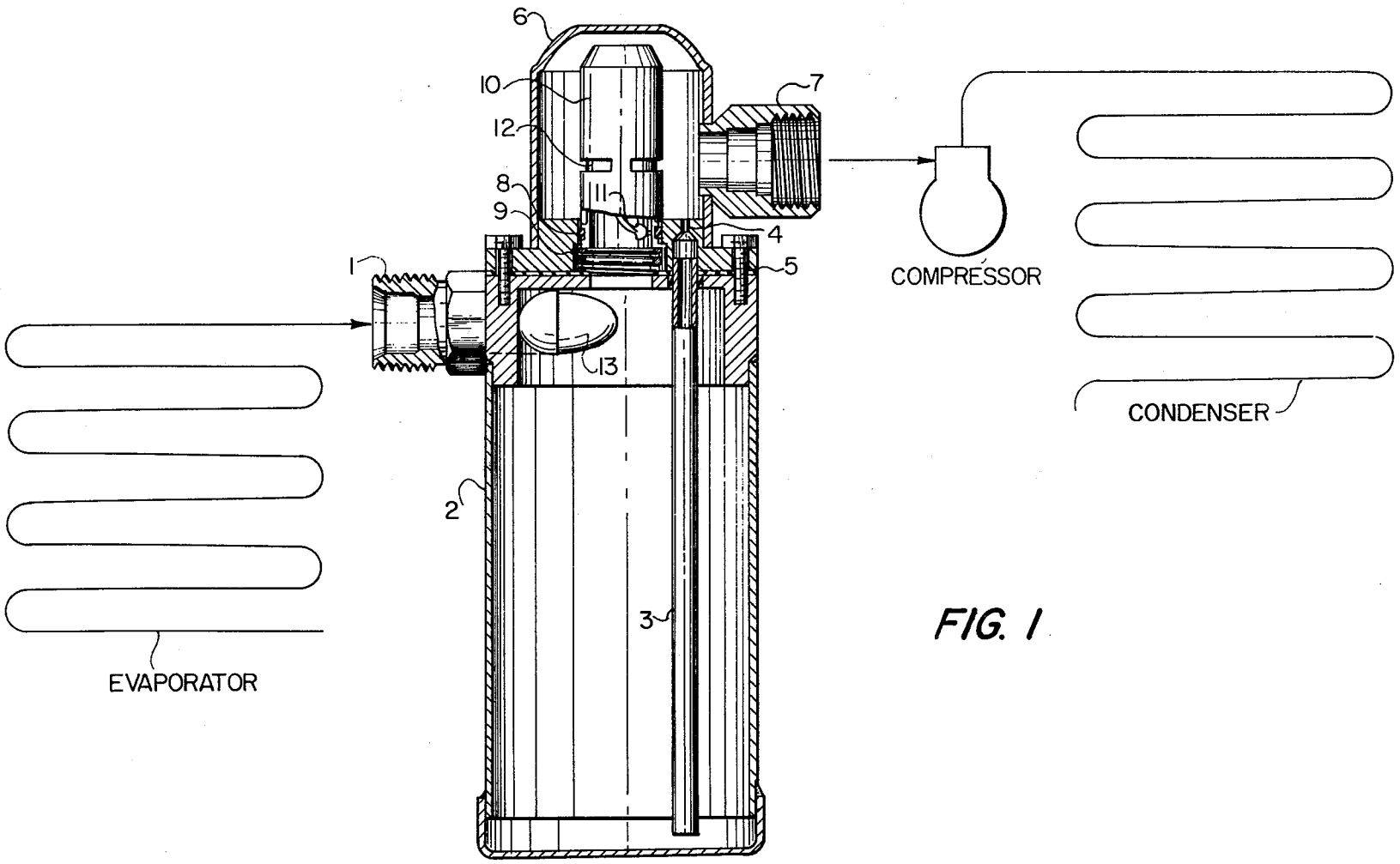
FIG. 1 is a schematic view, partially in vertical section, showing a combined evaporator pressure regulator chamber and accumulator, according to the present invention.

The primary function of a suction accumulator is to prevent liquid refrigerant from entering the compressor. It must also provide positive oil return at all system flow rates. Conventional accumulators are designed to provide adequate pressure drop for positive oil return at minimum system flow rates. However, when systems experience high maximum to minimum flow rate ratios, accumulator pressure drops at high load conditions become excessive. The combining of the EPR and accumulator can solve this problem. The EPR represents a finite pressure drop in the suction line at all operating conditions. In fact, the pressure drop across the EPR is generally greatest at low loads. Integration of the accumulator and the EPR allows the pressure drop across the EPR to be utilized for positive oil return. This arrangement allows the accumulator to be designed for minimum pressure drop while still performing its liquid trapping function. In FIG. 1 the refrigerant-oil mixture is shown entering the accumulator vessel 2 at inlet connection 1. Oil is returned through eductor tube 3 which is connected to outlet orifice 4. Orifice 4 is arranged to bypass the EPR 10, hence taking advantage of its pressure differential for oil return. The oil is mixed with the refrigerant vapors exiting the EPR 10 in chamber 6 and returned to the compressor through outlet connection 7. O-ring 8 provides a positive seal between the inlet and outlet of EPR 10 and compression spring 9 provides positive retention of the EPR 10 in its socket. EPR may be of the bellows-type containing an inert gas such as nitrogen which is charged through nipple 11. Pressure changes move the bellows which moves a spool or slide across peripheral slots 12, so as to regulate vaporous flow. A tangential entry device 13 may be positioned adjacent inlet connection 1, to provide consistent liquid and vapor separation.

Figure 2:
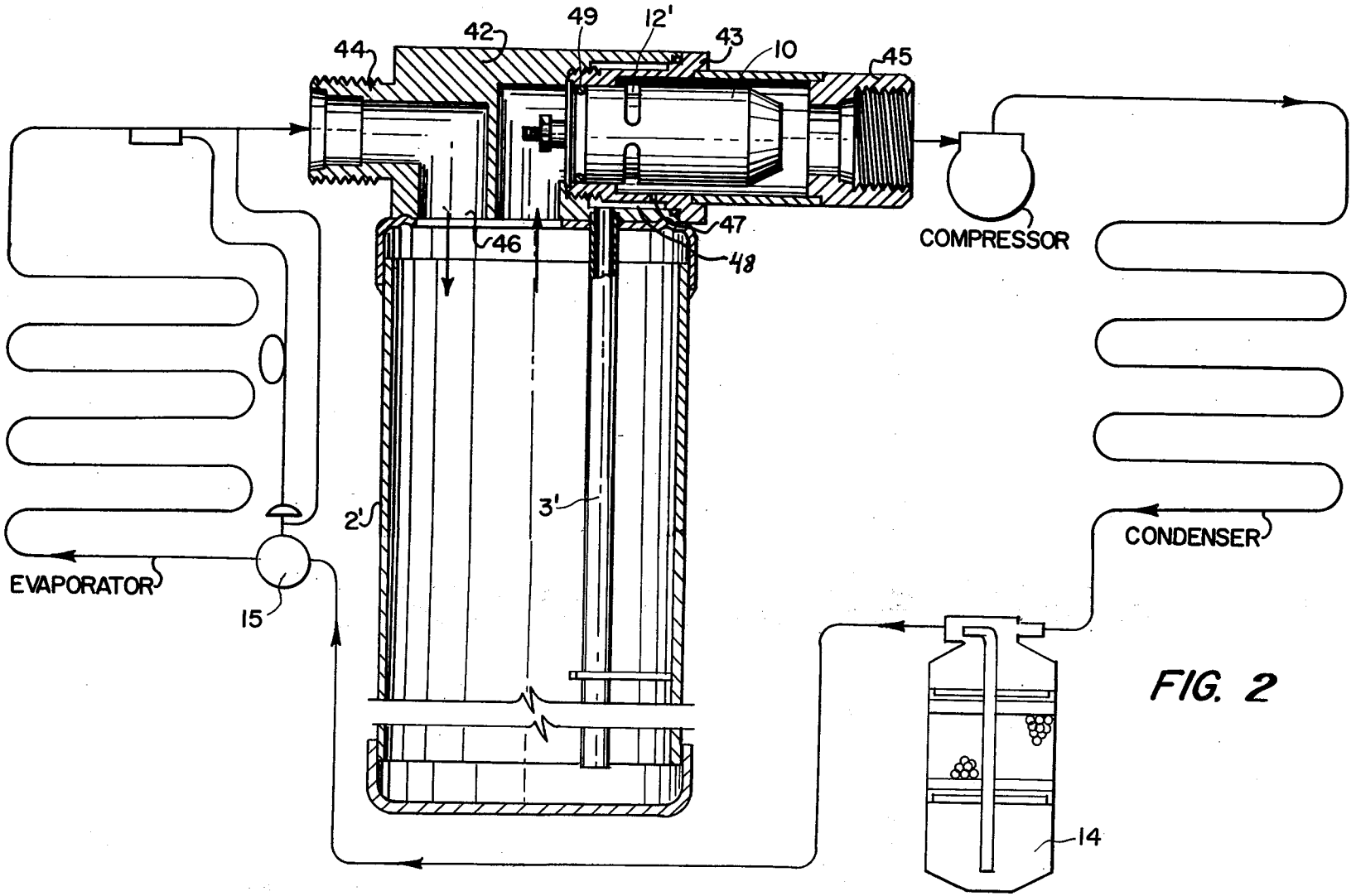
FIG. 2 is a schematic view, partially in vertical section, showing the evaporator pressure regulator horizontally and removably disposed with respect to the accumulator chamber and its inlet port exiting vapor axially from the accumulator chamber.

FIG. 2 schematically shows the combination EPR-accumulator (described in FIG. 1) in a complete system, including a filter-drier or receiver-drier 2' with a desiccant mounted therein. However, the receiver-drier is no longer fully required, since the accumulator can perform the liquid storage function for which the receiver was previously required. A thermostatic expansion valve 15 may be positioned intermediate filter-drier 14 and the evaporator. Two additional advantages are also obtained with this arrangement. First, loss of liquid subcooling, which normally occurs in a receiver, may be reduced. The much smaller filter-drier 14 is always liquid full, which enables it to better retain any subcooling obtained in the condenser. In fact, filter-drier 14 may provide additional subcooling, if it can be located in an ambient somewhat below condensing temperature. The second advantage is that evaporator performance can be improved, since proper control arrangement will allow "over-feeding" of the evaporator without risk of liquid entering the compressor.

The functions of the filter-drier may also be located within accumulator 2 as described, above.

FIG. 2 schematically shows a modified system that will function in a manner similar to the one described in FIG. 1. The accumulator/EPR hardware, however, has been arranged to allow horizontal mounting of the EPR. The accumulator chamber 2' is defined by a casing vertically extending and having a top and a bottom with colinear horizontally disposed inlet and outlet ports in the top opening into said chamber and respectively adapted for operative connection into said evaporator and said compressor. The removable adapter means 43 and 45 form an evaporator pressure regulator chamber positioned in said outlet port in communication with said accumulator chamber. Outlet fitting adapter 43 has connector 45 threadably removable adjacent the top of said accumulator chamber wherein this removable adapter means includes a threaded portion engaging a correspondingly horizontally threaded portion in said outlet port to further define an annulus between the adapter body and the outlet port 47. The adapter body 43 contains the pressure responsive evaporator pressure regulator 10' horizontally therein in compressive sealing relationship to the adapter means so as to guage admission of vapor through said evaporator pressure regulator chamber and said outlet. The eductor tube 3' extends independently from the bottom of said accumulator chamber into the evaporator pressure regulator chamber through annulus 48 and the adapter wall of said annulus via discharge orifice 47.

In the FIG. 2 system the EPR is installed in a "tee flow" type hardware arrangement 42 located at the top of the accumulator vessel 2'. This configuration also allows horizontal mounting of the EPR with access being provided by removal of the outlet fitting adapter 43. This configuration also provides in-line "in and out" connections 44, 45. By relocating the inlet conector 44, left and right angle patterns could also be arranged. Oil return control orifice 47 is thereby positioned intermediate annulus 48 and the evaporator pressure regulator chamber.

I claim:

1. A liquid trapping suction accumulator adapted for insertion in a vapor-compression refrigeration system between the evaporator and compressor, comprising:

A. An accumulator chamber defined by a casing vertically extending and having a top and a bottom;

B. colinear horizontally disposed inlet and outlet ports in the top, and opening into said chamber and respectively adapted for operative connection into said evaporator and said compressor;

C. removable adaptor means forming an evaporator pressure regulator chamber positioned in said outlet port in communication with said accumulator chamber; said adaptor means being further characterized as:

i. being threadably removably positioned adjacent the top of said accumulator chamber wherein said removable adaptor means includes a threaded portion engaging a correspondingly horizontally threaded portion in said outlet port and further defining an annulus between said adaptor body and said outlet port;

ii. said adaptor body containing a pressure responsive evaporator pressure regulator device horizontally therein and in compressive sealing relationship to the adaptor means so as to guage admission of vapor through said evaporator pressure regulator chamber and said outlet;

D. an eductor tube extending independently from the bottom of said accumulator chamber into said evaporator pressure regulator chamber through said annulus, the adaptor wall of said annulus including a discharge orifice perpendicular to said evaporator pressure regulator; and E. a filter-drier positioned between the outlet of the condenser in the system and a thermostatic expansion valve at the inlet of the evaporator in the system.

2. A liquid trapping suction accumulator as in claim 1, said evaporator pressure regulator including a pressure sensitive bellows valving device.

3. A liquid trapping suction accumulator as in claim 2, wherein said evaporator pressure regulator chamber is horizontally positioned with respect to the top of said accumulator chamber.

4. A liquid trapping suction accumulator as in claim 1 wherein said inlet port includes a conduit introducing said vapor axially with respect to said chamber.

* * * * *